United States Patent [19]

Hetke et al.

[11] 4,088,477

[45] May 9, 1978

[54] SHEATHLESS WIRE FEEDING OF ALLOY AND INOCULANT MATERIALS

[75] Inventors: Adolf Hetke, Livonia; Walter J. Evans, Ann Arbor, both of Mich.

[73] Assignee: Ford Motor Company, Dearborn, Mich.

[21] Appl. No.: 730,095

[22] Filed: Oct. 6, 1976

[51] Int. Cl.[2] ..... C22C 33/08

[52] U.S. Cl. ..... 75/130 R; 75/53

[58] Field of Search ..... 75/53, 129, 51, 130 R; 148/26

[56] References Cited

U.S. PATENT DOCUMENTS

| | | | |
|---|---|---|---|
| 3,728,109 | 4/1973 | Ohkubo | 75/51 |
| 3,729,309 | 4/1973 | Kawawa | 75/129 |
| 3,768,999 | 10/1973 | Ohkubo | 75/53 |
| 3,871,870 | 3/1975 | Nemoto | 75/53 |

*Primary Examiner*—P. D. Rosenberg
*Attorney, Agent, or Firm*—Joseph W. Malleck; Olin B. Johnson

[57] ABSTRACT

A method of treating molten metals is disclosed which employs a solid sheathless flexible strand containing particles of the treating agent uniformly suspended in a binder matrix, the latter being consumable or vaporizable upon contact with molten metal. Positive and predetermined solution conditions of the treating agent are assured by regulating the molten metal flow velocity to be at or above a predetermined minimum and the strand injection rate to be within defined limits.

7 Claims, 5 Drawing Figures

SHEATHLESS WIRE FEEDING OF ALLOY AND INOCULANT MATERIALS

BACKGROUND OF THE INVENTION

Adding metal treating agents to molten metal has undergone some degree of evolution within recent years to the point where such treating agents can be desirably added to the course of molten metal immediately before it reaches its casting cavity. Other stations for conventionally treating molten metal include in the furnace, in the ladle or holding unit, and in the stream as it is conveyed to a transfer ladle or dish. Treating agents can be used for a variety of purposes such as to alloy the base metal, inoculate or nodularize the base metal for purposes of producing a particular type of cast iron; a variety of other modes can create a change in chemistry of the base metal. One of the difficult aspects of adding such treating agents to molten metal, particularly in the furnace, is the inability to use a minimum amount that fully achieves solution; this is desirable because treating agents are typically highly expensive, they often go off into the slag, and may be lost by premature vaporization or oxidation. When the quanlity of base metal is large, the ability to homogenize or insure that all of the remote portions of the melt are affected by the treating agent is truly difficult.

Treating molten base metals in the ladle or in other holding units is somewhat better because the quantity of metal has been selectively reduced and because access is more convenient for purposes of stirring in the treating agent. If the treating agent is added to the mold, prior to pouring, the amount of treating agent will be more tailored to the specific quantity of metal cast and the furnace metal can be held in the untreated condition. Although the problems of volitization and pyrotechnics have been eliminated due to the closed condition of the mold which contains the treating agent, placed there in advance, several problems still remain. For example, the closed condition of the mold adds a degree of uncertainty as to reaction that is taking place out of sight of the operator. Each of the molds must be specially designed to receive the treating agent; any special modification of the mold line is economically unwelcome. Also, adding the agent to the mold prevents the mode from being adaptable to variations in base metal quality.

In some isolated instances, the industry has turned to steam treatment which involves injecting addition agents to a molten stream carried either in a closed trough or in an open spill way resulting from pouring a ladle. The stream is relatively low velocity since it is unnozzled and merely urged by gravity. In stream treatment, the art has employed rigid treating rods progressively inserted into the spill way stream or granular treating agents flowed into the stream.

SUMMARY OF THE INVENTION

A primary object of this invention is to provide an improved method of treating metals which is characterized by (a) ease of use and adaptability to existing foundry methods and apparatus (b) lower cost in terms of materials consumed and manpower required, (c) greater control with the process for preciseness and flexibility, and (d) higher productivity.

Another object of this invention is to provide an improved method for treating molten metals which can be used interchangeably for alloying, inoculating, nodularization and a wide variety of other metallurgical processes where additions must be made to molten metal.

Still another object of this invention is to provide a method of treating metals for producing a chemical or structural change in the metal, the method facilitating simplified warehousing of the ingredients required to utilize such method.

Yet still another object of this invention is to provide a method of treating metal which can be used at any point along the path of utilization of molten metal thereby freeing up rigid commitment of a furnace to one specific end use and permitting a variety of uses of different portions of the furnace melt.

Yet still another and more specific object of this invention is to provide an intermediate product useful in the form of a sheathless strand for treating molten metals. The strand contains a consumable solid binder carrying a particulate treating agent suspended therein, the product being useable much as a wire. The injectable strand insures total solution and uniformity of mixing with an exposed stream of molten metal when the stream is conducted at a predetermined flow rate and the wire is introduced transversely, but not necessarily perpendicular, to the stream at a specific rate.

DETAILED DESCRIPTION

To increase the flexibility of use of a method for treating molten metal, this invention comprehends preparation and use of a flexible strand carrying a regulated amount of treating agent formed much in the fashion of a wire. The wire being injectable at a predetermined feed rate into a flowing stream of molten metal which is flowing at a controlled flow rate substantially uniform throughout the stream and selected from the range of 15–40 lbs./sec. This is to be contrasted with the flow created by spilling molten metal from a ladle which provides an uncontrolled flow, nonuniform flow rate which is variable throughout the stream.

A preferred method for carrying out the process aspect of this invention comprises the following:

(1) Preparing a substantially uniform mixture of solid particles of a treating agent and a solid flexible binder vaporizable upon contact with said molten metal, the binder constituting about 10–20% of the whole.

The binder may be particularly comprised of polyethylene esterized in the range of 10–20%. The binder must be characterized by (a) vaporizability upon contact with molten metal, (b) ease of extrusion to bind said solid particles as a suspension therein, (c) moldable, (d) flexibility to permit the strand to be coiled but rigid enough to be self-supporting when held at one end as it is injected into the stream.

The treating agents can vary depending upon the particular application; in the case of inoculation, the treating agent would most likely consist of one or more of the following: a carbonaceous material or a ferrosilicon alloy containing 45–85% Si and one or more of the following elements: calcium, aluminum, strontium, barium, magnesium or zirconium.

In the case of nodularization of molten nodular base iron, the agent may consist of magnesium, in an alloyed or pure form, or cerium, also in an alloyed or pure form. The treating agent can be in the form of flakes, chips, chunks or powder, but preferably the particles should, for purposes of inoculation or nodularization, be in the size range of 20–200 mesh.

Figure 1:
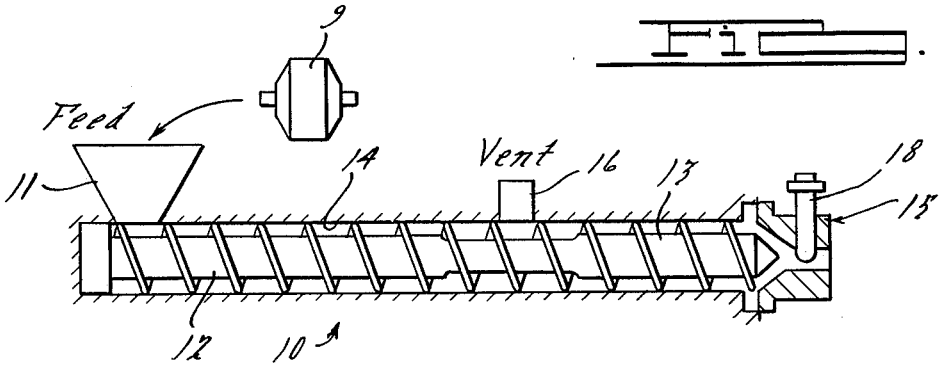
FIG. 1 is a schematic elevational view of one type of apparatus that may be employed in converting a mixture of a metal treating agent and a consumable or vaporizable plastic binder into a solid homogeneous coilable strand.
Figure 2:
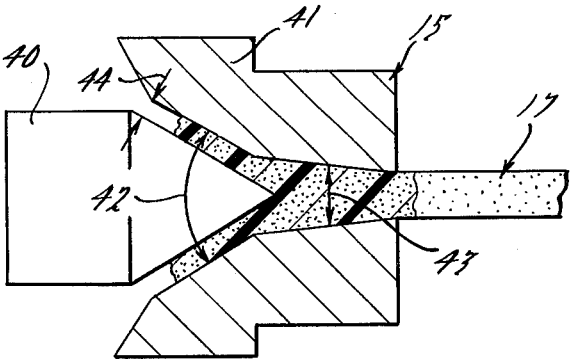
FIG. 2 is an enlarged sectional view of one type of die employed for extruding the mixture of said treating agent and flexible binder.
Figure 3:
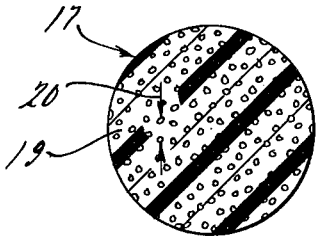
FIG. 3 is an enlarged cross of the solid extruded strand.
Figure 4:
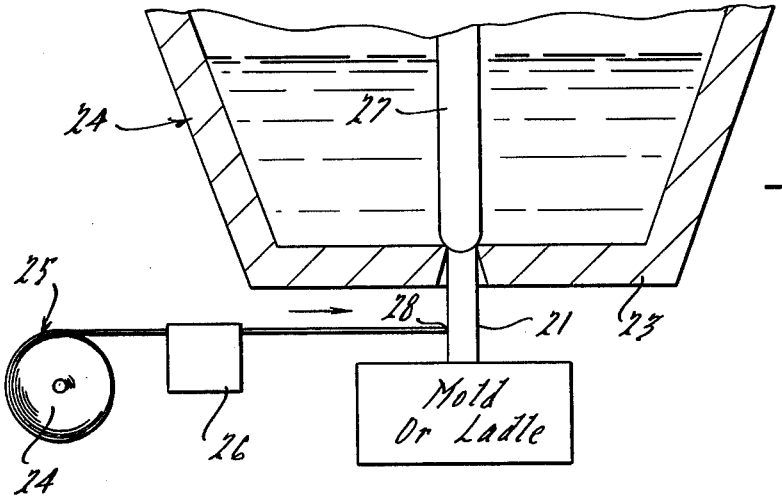
FIG. 4 is a schematic view of one type of metal treating arrangement wherein a solid coilable strand is fed transversely into a prescribed flow of molten metal to be treated.

(2) As shown in FIG. 1, the mixture is homogeneously prepared in a rotatable mixing chamber 9 and then fed into an extruding machine 10 at one end 11 where it is heated to temperature of about 175° F and forced by way of a pair of axially aligned screws 12 and 13 into and through a cylinder 14 and into extruding die assembly 15. A vent 16 is employed to maintain proper pressure. The particles are extruded along with the binder to form a cylindrical strand 17 having a diameter typically in the range of 0.187–0.250 inches. The die is controlled by valving 18 to insure that the extruded strand has a uniform cross-section unvarying throughout the entire strand by no more than ± ½%. The die may employ a conical mandrel 40 and a conical piece 41, the former having a uniform cone angle 42 and the latter having a stepped cone angle comprised of angle 42 and angle 43. The stepped cone angles may be about 60° and 6° respectively. The gap 44 is controlled to obtain the desired strand diameter. The strand is a useful intermediate product having reactive particles 19 distributed substantially uniformly through its transverse section and length to enable a user to precisely calculate reactive weight by merely separating a precise length. The strand is sheathless and, most importantly, certain of the particles are exposed to the exterior of the strand. Particle separation is typically no greater than 0.030 inches.

(3) The molten metal is independently formed into an exposed stream 21 having a known rate of flow that is controlled and uniform throughout the stream cross-section. The flow rate is selected from the range of 15–40 lbs./sec. This may be provided by way of a regulated orifice 22 within the wall 23 of an insulated holding vessel 24 containing a supply of the molten metal. The flow rate should be at least 15 lbs./sec. A stopper rod 27 may be used to control the orifice 22. The relationship of the flow rate of the molten metal and the rate at which the strand is to be fed to it is critical for this invention. The relationship insures that pyrotechnics are avoided and a rapid reliable solution of the treating agent into the molten metal takes place.

(4) The strand is coiled onto a spool 24 and is fed from the apparatus 25 by coordination of the spool rotation and a feed gate 26. The strand is fed into the exposed stream 21 at an angle transverse to the centerline of the stream (about 10–90°). The strand is exposed to approximately ambient conditions up to the point 28 at which it contacts the molten stream. The rate of injection is predetermined relative to the flow rate of molten metal. Preferably for nodularization, such feed rate is about 6 inches per second with the flow of said metal being about 20–30 lbs./sec. The vaporized binder typically may result in a carbon residue which is beneficial for metal treatment.

Polyethylene is a preferred plastic binder for defining the strand of this invention. Its characteristics are: it has a collapsing temperature of about 100° C (it gradually decreases in volume until a temperature of 200° C is reached whereby it becomes a molten plastic mass and then eventually vaporizes). In the collapsed or plastic state, the polyethylene can be forced under suitable pressure and molded into a variety of shapes while containing the particles. The density of the polyethylene should be about 0.926 grams/cubic centimeter.

An alternative binder may be used in the form of polystyrene or polyurethane, both of which are vaporizable upon contact with molten metal. However, polystyrene does not lend itself to extrusion as does polyethylene. One mode of forming polystyrene is by use of a blowing agent. The blowing agent (volatile paraffinic hydrocarbon) is mixed with the polystyrene and reactive agent mixture, usually in a volume amount of about 7–8%, and the combined mixture increases in size upon slight heating of the polystyrene. The size may increase from 2–50%. The heated polystyrene mixture is passed through an extrusion mold; expansion is controlled at the die by steam which fuses the extruded strand. The strand is then cooled by water.

Figure 5:
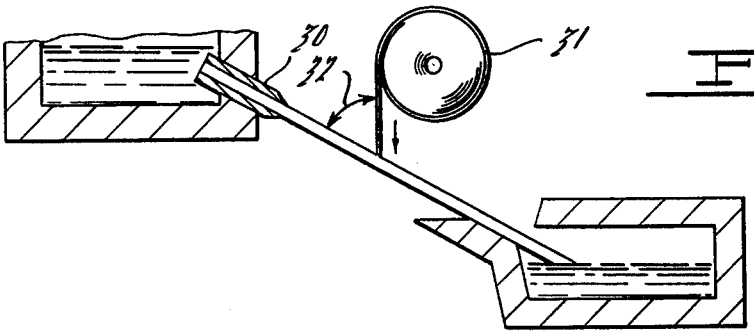
FIG. 5 is an alternative embodiment, depicting a molten metal holding unit employing a nozzle for ejecting an untreated molten metal stream at a specific velocity, said strand being shown in an alternative feeding apparatus for reaction therewith.

Another modification of the treating arrangement appears in FIG. 5. The stream is formed by passing the molten metal through a nozzle 30 adapted to insure a known flow rate. The strand is lowered onto the stream from a spool and engages the stream at an angle 32 of 10°–90°.

We claim:

1. A method for treating molten metal with a reaction agent, comprising:

(a) preparing and defining a continuous strand consisting of a uniform mixture of one or more reactive agents in particulate form and a solid flexible binder vaporizable upon contact with said molten metal, said strand being sheathless, and tubular in shape and having a cross-sectional diameter of 0.187–0.250 inches unvarying more than ±.5%, said binder being less than 20% of said strand, (b) form an exposed stream of said molten metal having a controlled and substantially uniform flow rate through said stream selected from the range of 15–40 lbs./sec., and (c) progressively injecting said strand transversely into said stream at a rate to provide a predetermined reaction between said agent and molten metal, said strand being subjected substantially ambient pressure and temperature conditions up to the instant and point of injection into said molten stream.

2. The method as in claim 1, in which said binder is comprised of polyethylene of the type esterized 10–20%, said polyethylene including a plasticizer in an amount of 10–20%; said strand being flexible but sufficiently rigid to be self-supportable when held at one end and injected into said stream.

3. The method as in claim 1, in which said reactive agents consist of particles in the size range of 20–200 mesh.

4. A method for inoculating grey iron, comprising:

(a) preparing and defining a continuous solid strand consisting of a substantially uniform mixture of one or more inoculating agents selected from the group consisting of carbon, silicon, calcium, zirconium, aluminum, carium and strontium, said inoculating agents being in the particulate form and mixed with a solid flexible polyethylene binder vaporizable upon contact with said molten metal, said strand being sheathless, (b) forming an exposed controlled stream of said grey iron, said stream having a flow rate of at least 15 lbs./sec., and (c) feeding and injecting said strand into said stream at a rate to provide a predetermined inoculating reaction between said agent and molten grey iron, the total amount of inoculant selected to be added to the metal varying between 0.1–.8% by weight of the molten grey iron, but when selected said total inoculant being added in an unvarying proportion.

5. A method for nodularizing molten iron having a molten chemistry condition such that the graphite would define flake graphite if solidified in said condition, comprising:

(a) preparing and defining a continuous strand consisting of a substantially uniform mixture of a nodularizing agent in particulate form and a solid flexible binder vaporizable upon contact with said molten grey iron, said strand being sheathless, (b) forming an exposed stream of said molten iron leading immediately to a mold cavity, said stream having a controlled flow rate substantially uniformly throughout said stream and selected from the range of 15–40 lbs./sec., and (c) feeding and injecting said strand into said stream at a rate to provide an immediate predetermined nodularizing reaction between said agent and molten iron.

6. The method as in claim 5, in which said inoculating agent consists of pure magnesium and said binder comprises between 10–20% of said strand.

7. The method as in claim 5, in which said strand is injected at a feed rate of about 6 in./sec. and said stream has a controlled flow rate selected from the range of 20–30 lbs./sec.

* * * * *